United States Patent [19]

Rüttgerodt

[11] 4,324,169

[45] Apr. 13, 1982

[54] MAIN BATTLETANK TURRET

[75] Inventor: Gottlieb Rüttgerodt, Kassel, Fed. Rep. of Germany

[73] Assignee: Wegmann U. Co. GmbH, Kassel, Fed. Rep. of Germany

[21] Appl. No.: 744,947

[22] Filed: Nov. 19, 1976

[51] Int. Cl.[3] ..... F41H 5/20; F41H 7/08

[52] U.S. Cl. ..... 89/36 L; 89/36 K

[58] Field of Search ..... 89/34, 36 H, 36 K, 36 L, 89/40 B

[56] References Cited

U.S. PATENT DOCUMENTS

| | | | |
|---|---|---|---|
| 2,594,198 | 4/1952 | Motley | 89/36 K |
| 3,261,263 | 7/1966 | Hilfing et al. | 89/36 H |
| 3,602,088 | 8/1971 | Spring | 89/36 K |
| 3,722,357 | 3/1973 | Schallen | 89/36 H |
| 3,724,324 | 7/1970 | Zielinski | 89/36 K |
| 3,911,787 | 10/1975 | Seibel | 89/34 |
| 3,994,202 | 11/1976 | Tidstrom | 89/36 L |

*Primary Examiner*—Stephen C. Bentley

*Attorney, Agent, or Firm*—L. Lawton Rogers, III

[57] ABSTRACT

A battletank having a turret with especially heavy armor for containing the weapons system and a crew whereby the minimum possible dimensions of the armor and sufficient space for the crew are achieved, the power supply installations, the electrical and electronic assemblies and the ammunition being located in spaces outside of and behind the crew's space and separated from the latter by protective bulkheads. The ammunition, in order to avoid endangering the crew, is arranged in the ammunition space such that the warheads take effect in a direction opposite to that of the crew's space. In addition, the gun sight and observation devices can be arranged outside of the crew's space. The spaces outside of the crew's space may be accessible from the outside individually through access doors and the weapons system can be retractable for loading into a loading position in which the breech of the weapon is approximately at the same height as a connecting opening between the crew's space and the ammunition space.

2 Claims, 1 Drawing Figure

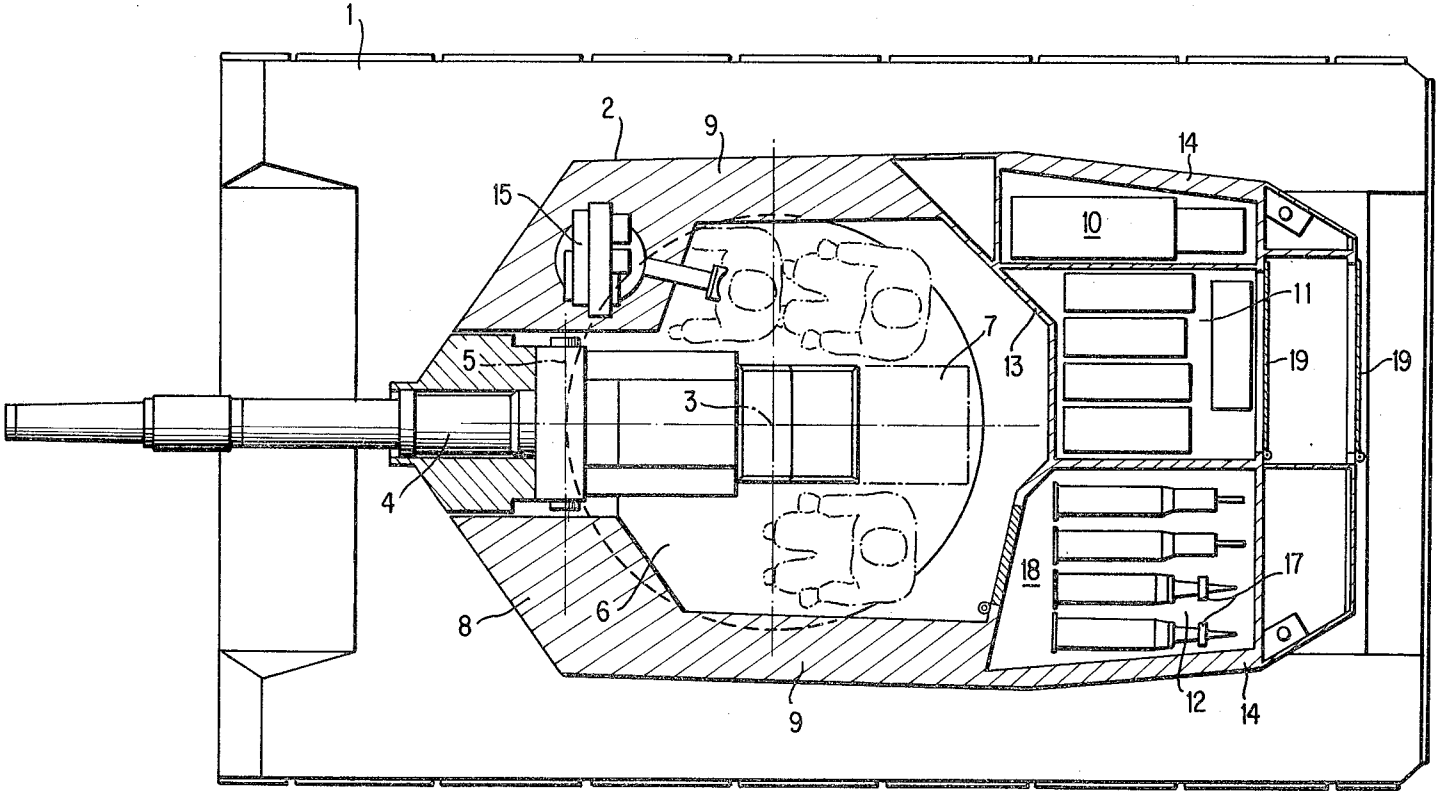
1
2
3
4
5
6
7
8
9
9
10
11
12
13
14
14
15
17
18
19
19

MAIN BATTLETANK TURRET

The invention concerns a main battletank turret, in particular for armored vehicles, The as-a-rule rotatable main battletank turrets have an especially heavy protection on the front and flanks. Since this especially heavy armor has considerable weight, the volume of this armor should be kept as small as possible wherefrom it also results that the crew's compartment must be reduced in size as much as possible. However, limits are placed on this reduction in size because the turret must house not only the crew, which for example consists of three men, but also all of the equipment essential for operation of the tank turret, more particularly the electrical and electronic assemblies, power supply and ammunition supply. According to the invention, an essential reduction in size of the especially heavy armor of the crew's compartment is thereby obtained in that all equipment not functionally required in the crew's compartment, especially the power supply installation, electrical and electronic assemblies, and the ammunition are arranged in spaces outside of and behind the crew's compartment. These spaces arranged behind the crew's compartment are appropriately separated from the latter by bulkhead partitions. This arrangement enables on one hand achieving a situation wherein the crew's compartment can be quite small with an especially heavy armor and thereby enabling also a decrease in weight of the armor whereas, on the other hand, the additional equipments required in the tank turret are still protected by this especially heavy armor at least against frontal fire. These equipments are, however, as before available in the turret and accompany all traversing movements of the turret.

A further gain in space can be achieved by arranging the gunsight and observation systems likewise outside of the crew's compartment and indeed in the especially heavy armor. The arrangement of gunsight and observation systems in the armor signifies at the same time no or, in any case, no considerable weakening of the armor insofar as a type of armor well known by itself is utilized which contains cavities. The gunsight and observation equipment can be housed in these cavities.

The subject of the invention provides the possibility of overcoming still one other difficulty. Oil vapors which have up until now degraded the quality of air in the crew's compartment come out of the power supply equipment and from others, for example, pressure oil units. The invention provides the capability of ventilating spaces located outside of the crew's compartment and even separate therefrom so that no oil vapors or other gases or vapors degrading the air can reach the crew's compartment and the latter is not heated up. The ammunition is arranged in such a manner in the magazine area separate from the crew's compartment that the warheads of the ammunition have an effect in a direction away from the crew's compartment so that when ammunition blows up as a result of a direct hit, the crew is not thereby endangered. The spaces arranged outside of the crew's compartment can further be accessible individually from the outside through flaps whereby the maintenance is made much easier. The loading of the weapon manually, whether from halt or while on the move, is a process which requires relatively much space. In order to reduce this space in size, the weapon system can be appropriately arranged such that it is retractable for loading into a specified loading position in which the breech mechanism of the weapon is positioned at about the same height with a connecting opening to the ammunition stowage compartment. The enables the weapon system to be shifted far into the crew's compartment so that considerable armor protective weight is saved and the center of gravity of the entire system can be kept in the vicinity of the turret axis.

A form of construction of a main battletank turret consistent with the invention is illustrated in the FIGURE.

The main battletank shown schematically in the FIGURE 1 has a turret 2 which is rotatable around its vertical axis 3. The weapon system 4 is rotatable around the horizontal axis 5 and projects with its breech block 7 far into the crew's compartment 6. The crew's compartment is enclosed by an especially strong armor which consists of part 8 protecting from frontal firing and parts 9 protecting against flank firing. Consistent with the invention, the power supply 10, electronics 11 and ammunition 12 are in their own spaces which are located behind the crew's compartment and separated from the crew's compartment by bulkhead partitions 13. At the same time, the bulkhead partition between the crew's compartment 6 and the ammunition compartment 18 is suitably thicker than the other bulkhead partitions. An armor 14 which is not as thick as the armor of the crew's compartment protects these additional spaces. A gunsight system and/or an observation system 15 are, as portrayed schematically in the FIGURE, housed within the armor 8.

The ammunition is housed in the ammunition compartment 18 such that the warheads 17 point to the rear so that, in the event that the ammunition explodes as a result of a direct hit, the effect of the warheads is not directed against the crew's compartment. In the bulkhead partition between the ammunition compartment and the crew's compartment, there is an opening which is not shown in the FIGURE through which ammunition currently required for loading can be passed through into the crew's compartment from the ammunition compartment. Through flaps 19 at the rear of the tank turret is found the space in which electronics 11 and other electrical apparatus can be housed. It is accessible from the outside. In the same way, the ammunition space and the space for power supply is also accessible through flaps or covers which are not shown in the FIGURE. This arrangement enables on one hand keeping as small as possible the especially strong protective armor for protecting the crew's compartment and, on the other hand, enables all equipment required functionally in the turret to be available in the turret and the functional interaction with the crew's compartment is not adversely affected. On the contrary, the situation is avoided whereby the air in the crew's compartment is degraded by gases or vapors from the supply equipments or the crew's compartment becomes overheated owing to heat produced in the equipments.

The arrangement of the electronics 11 in their own space as well as in the crew's compartment as a space shielded from the outside in by metal plates has the additional advantage in that the often-sensitive electronics are shielded against electromagnetic disturbances from the outside or from the crew's compartment (radio apparatus).

I claim:

1. A battletank turret having a relatively heavily armored space for the weapons system and for the crew of the battletank and a relatively lightly armored space for the power supply installations of the battletank and for the ammunition for the weapons system, said relatively lightly armored space being located rearwardly of said relatively heavily armored space and being divided into a plurality of subspaces each individually accessible from the outside of the battletank, one of said subspaces including means to store ammunition for the weapons system in a manner such that the warheads are directed away from said relatively heavily armored space;

means for ventilating said relatively heavily armored space separately from said relatively lightly armored space to reduce degradation of the atmosphere in the relatively heavily armored space as a result of heat and vapors from fuel, lubricants, and the like, the armor for said relatively heavily armored space containing a void sufficient to house sighting and observation equipment; and, means for mounting sighting and observation equipment in the void in said armor.

2. The battletank turret of claim 1 including means for providing access from said relatively heavily armored space to said ammunition subspace; and means for retracting said weapons system into said relatively heavily armored space to thereby position the breech of said weapons system at an elevation substantially the same as said ammunition subspace access to thereby facilitate loading of the weapons system.

* * * * *